United States Patent [19]

Fahrbach

[11] 4,256,268

[45] Mar. 17, 1981

[54] COIL WINDING MACHINE TO WIND SADDLE-SHAPED COILS

[75] Inventor: Rudolf Fahrbach, Branchville, N.J.

[73] Assignee: Universal Manufacturing Co., Inc., Irvington, N.J.

[21] Appl. No.: 12,297

[22] Filed: Feb. 15, 1979

[51] Int. Cl.[3] ..... H01F 41/06; B21C 47/02; B65H 81/00

[52] U.S. Cl. ..... 242/7.11; 140/92.1; 242/7.14

[58] Field of Search ..... 242/7.11, 7.14, 35.5; 140/92.1; 242/7.18

[56] References Cited

U.S. PATENT DOCUMENTS

| | | | |
|---|---|---|---|
| 2,834,559 | 5/1958 | Nagy | 242/84.21 R |
| 3,101,180 | 8/1963 | Sadorf | 242/7.11 |
| 3,811,630 | 5/1974 | Muskulus et al. | 242/7.11 |
| 4,056,238 | 11/1977 | Ciniglio et al. | 140/92.1 |

FOREIGN PATENT DOCUMENTS 2508988 2/1976 Fed. Rep. of Germany .

*Primary Examiner*—Billy S. Taylor
*Attorney, Agent, or Firm*—Eliot S. Gerber

[57] ABSTRACT

A machine for winding saddle-shaped coils, of the coil type used as beam deflection coils in television and CRT tubes, includes a winding head having a housing removably fixed to the machine base; a gear train within the housing and driven by motor means on the base; a set of hollow bushings rotated by the gear train and each axially reciprocated by a cam pin; and flyer arms having wire guides, the flyer arms being fixed to the bushings. The flyer arms are rotated and are simultaneously axially reciprocated so that they cross each other in different planes.

11 Claims, 4 Drawing Figures

COIL WINDING MACHINE TO WIND SADDLE-SHAPED COILS

BACKGROUND OF THE INVENTION

The present invention relates to machines for winding electrical wire coils and more particularly to coil winding machines for winding saddle-shaped coils.

At the present time it is known that wires carrying electrical current may be wound into coils of many shapes and sizes. It has been found, after years of intensive theoretical and practical studies by leading electronic companies, that various configurations of saddle-shaped coils provide the desired electromagnetic fields in various applications. Generally the size, wire configuration and external shape of the saddle-shaped coil is proprietary, or of special design, and associated with a specific utilization, for example, as the vertical deflection coil in a 19-inch shadow mask type of color television picture tube. Other uses for saddle-shaped coils include vertical and horizontal wide-angle deflection yokes in which the coils are sometimes called "saddle yokes", beam deflection coils in CRT tubes for computer display terminals and other uses.

Many of these saddle-shaped coils present difficult requirements to meet in production. Their shape is often highly complex with the same wire in a single turn lying flat in two different planes, being vertical and turning in three of four directions. It is desired, in order to obtain an accurate electromagnetic field, that each coil, insofar as possible, have its wires spaced according to a predetermined pattern. The wires have a conductive core, generally of copper or a copper alloy, covered by an insulative varnish, generally of a plastic resin. The insulative varnish is selected so that it softens or melts under heat to adhere the wires to each other.

One type of machine presently used to wind such saddle-shaped coils mounts a mandrel, i.e., a form around which the coil is wound, and rotates the mandrel in a lath-like machine. The rotating mandrel draws wire from a wire supply and the wire is laid in place using deflecting rods. After the coil is wound it is held in place in the lath-like machine and compressed by a hydraulic press and then heated by passing current through the wire. The heat softens or melts the wire coating, for example, a suitable epoxy, so that the wires are adhered together in the desired final coil shape. The coil is then removed from the lath-like machine and cooled. In some systems the pressure step is performed prior to heating of the coil. That type of process, using lath-like winding machines, is relatively slow and costly. The mandrel may be relatively massive, for example, 6 inches by 6 inches, and may have to be turned at slow speed, for example, 150 rpm, so that it may take two minutes to wind, compress and heat each coil.

British patent specification No. 1,499,834, published Feb. 1, 1978, to Plessey Company, describes a coil-winding machine for winding saddle-shaped coils. It discusses the previously known types of machines in which a rotatable mandrel of large mass is rotated and draws wire, the wire being laid down by deflecting bars. It states that such machines are relatively large and complex and the deflecting bars are easily deformed. The Plessey specification describes a machine in which a stationary mandrel is wound using two crank arms (flyers) which are rotated and each having a pulley to guide a wire. Each arm is fixed to a hollow shaft which is reciprocated (turning back and forth) about its axis 180° and which serves as a guide for a wire. After the mandrel is wound it is pressed in a pneumatically operated press and heated by internal coils or by passing current through the wire.

In German Offenlegungsschrift No. 2,508,988 of Feb. 5, 1976 to N. V. Philips a coil winding machine for saddle-shaped coils uses two flyer arms in its FIG. 4, each of which is rotated by a driven gear wheel, the description speaking of the arms rotating in opposite directions.

The British patent specification No. 1,497,696, published Jan. 12, 1978, to Philips Electronic And Associated Industries, and its corresponding German Offenlegungsschrift No. 2,552,882, describe apparatus for winding a special type of saddle-shaped coil having series connected sections separated by spaces. The mandrel uses movable pins to form the spaces, the pins being connected to a double-acting piston. At its FIG. 1 a rotary carriage carries a mandrel to a number of positions (work stations) at one of which a single winding arm winds wire onto the mandrel.

In British patent specification No. 1,292,207 published Oct. 11, 1972, to RCA, a saddle-shaped coil is wound in an arbor formed by male and female members having rods or vanes to deflect the wire. In order to improve the accuracy of laying the coil, the arbor has magnets which cooperate with the pulsing of the wire to provide a set of electromagnetic fields for placing the wire.

SUMMARY, OBJECTIVES AND FEATURES OF THE INVENTION

The present invention provides a coil winding machine in which a fixed mandrel is rotated in movement-and-dwell steps on an index table to work stations. At the first work station the fixed mandrel is simultaneously wound with 1, 2, 3 or 4 wires using a winding head having flyer arms. Each flyer arm receives the wire through a turned hollow shaft and is rotated and simultaneously is reciprocated away from and toward the winding head. The movement of the flyer arms is accurately arranged so that they pass each other in different planes even though the arms may move in the same, or different, directions of rotation. The mandrel, after being wound with wire, is progressed to a work station at which the coil is compressed by a pneumatic double-action press and heated by passing current through the wire to soften or melt the wire coating and adhere the wire into the final coil form.

It is an objective of the present invention to provide a coil-winding machine for winding saddle-shaped coils in which the coil is wound on a mandrel which is fixed during the winding operation to thereby avoid the relatively expensive and slow coil winding operation associated with a rotatable mandrel.

It is a further objective of the present invention to provide a coil-winding machine for winding saddle-shaped coils in which the coil is wound on a mandrel which is fixed during the winding operation so that the coil may be heated by passing current through the wound wire without the use of slip rings and so that the wound coil may be positioned to be compressed in a double-action press.

It is a still further objective of the present invention to provide a coil-winding machine for winding saddle-shaped coils in which the coil is wound on a mandrel which is fixed during the winding operation and which winds the coils at a relatively higher speed of production, thereby lowering the cost of winding each of such coils.

It is another objective of the present invention to provide a coil-winding machine for winding saddle-shaped coils in which the coil is wound on a mandrel which is fixed during the winding operation and which lays down the wire in a predetermined and accurate manner.

It is a still further objective of the present invention to provide a coil-winding machine for winding saddle-shaped coils in which the coil is wound on a mandrel which is fixed during the winding operation and in which the size and shape of the coils being wound may readily and relatively easily be changed so that one size and configuration of such coil may be wound one day, or other period, and an entirely different size and configuration of coil may be wound the next day, or other period.

It is a still further objective of the present invention to provide a coil-winding machine for winding saddle-shaped coils in which the coil is wound on a mandrel which is fixed during the winding operation and on which the wires are laid down using relatively controlled tension on the wire to prevent its breaking and in which the wire is laid down without using deflecting rods which may become deformed.

It is a still further objective of the present invention to provide a coil-winding machine for winding saddle-shaped coils in which the coil is wound on a mandrel which is fixed during the winding operation and in which the wire lead mechanical does not cause undue twisting of the wires because the wire is not lead to the mandrel using a flyer arm guiding two or more wires.

It is a feature of the present invention to provide a machine for winding a coil, such as a saddle-shaped television or CRT deflection coil, onto a mandrel with one or more wires. The machine includes a base, a motor means mounted on said base, and a winding head mounted on said base and driven by said motor means. The base may be part of a work station of an index table system. The winding head includes a housing which is preferably easily removably attached to the base. First and second wire feed means, preferably hollow bushings, are each rotatively mounted in the housing and each is adapted to feed one of the wires therethrough. The winding head also includes a first and a second flyer arm connected respectively to the first and second wire feed means, i.e., connected to the bushings, and a first and a second flyer wire guide means, preferably ring-like eyelets, respectively carried by the first and second flyer arms to guide their respective wires onto the mandrel. Flyer arm rotation means rotate each of the flyer arms, preferably by a gear train driving the bushing, the rotation means being driven by the motor means. Flyer arm axial reciprocating means reciprocate each of the flyer arms simultaneously by cam action on the bushings, so that the flyer arms cross each other in different planes.

BRIEF DESCRIPTION OF THE DRAWINGS

Other objectives and features of the present invention will be apparent from the following detailed description of the present invention, providing the inventor's presently known best mode of practicing the invention. The detailed description should be taken in conjunction with the accompanying drawings, in which.

DETAILED DESCRIPTION OF THE INVENTION

The coil winding head illustrated in the accompanying drawings is part of a coil winding machine including a motor means 8 such as an a.c. motor to drive the coil winding head. The coil winding machine is the first work station and is positioned proximate to an indexing table. It is capable of laying down drawn wire on the mandrel using wire in the approximate range of #22 to #36 AMG (0.68 mm to 0.15 mm) to form saddle-shaped coils up to approximately $4\frac{1}{2}$ inches in diameter.

An indexing table carries a plurality of mandrels upon which the coils are wound, with the mandrels being positioned near the periphery of the indexing table. The indexing table operates in a series of timed movements and dwell steps which carry each of the mandrels in succession to the various work stations.

At the first work station the index table is held in its dwell step and the coil winding head, illustrated in the accompanying drawings, winds the saddle-shaped mandrel with 1, 2, 3 or 4 wires depending upon the coil type, size and configuration. The wound coil on its mandrel is then carried by the indexing table to the next work station at which a double-action pneumatic press compresses the wound coil into approximately its finally desired shape and configuration while the coil is being heated. Preferably such heating occurs by current passing through the coil which melts the heat meltable or softenable plastic resin covering of the wire. The plastic adheres the wires so that the coil is fixed in its desired configuration. Such compression occurs during the dwell step of the indexing table. The indexing table then carries the compressed coil to a third work station at which the coil may then be cooled, for example, by flowing cold air on the coil and removed, either manually or automatically by machine, from its mandrel. The empty mandrel is then carried by the indexing table, in the next indexing step, to beneath the coil winding machine where the steps are repeated.

Figure 1:
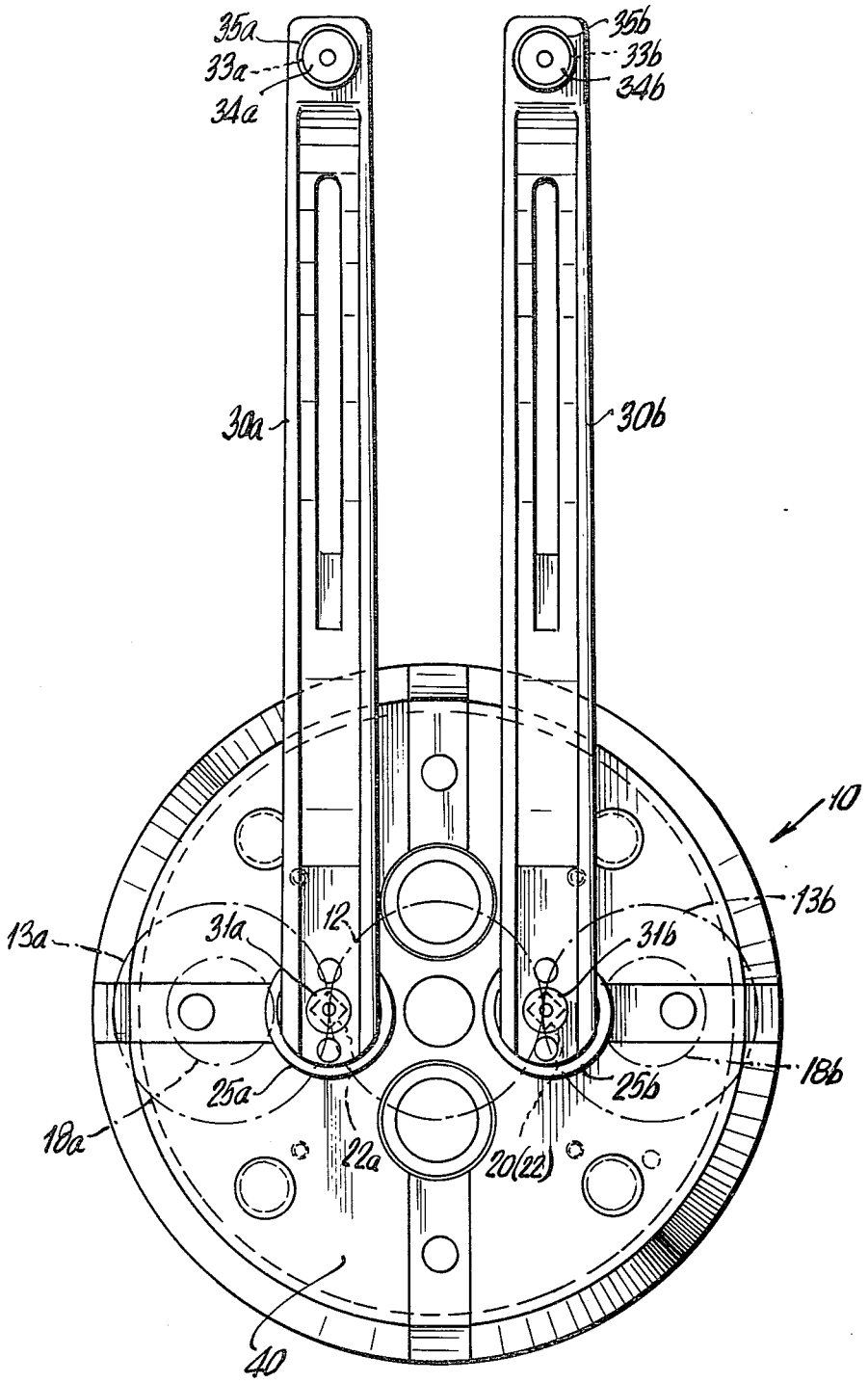
FIG. 1 is a front plan view of the bifilar winding head of the winding machine of the present invention.
Figure 2:
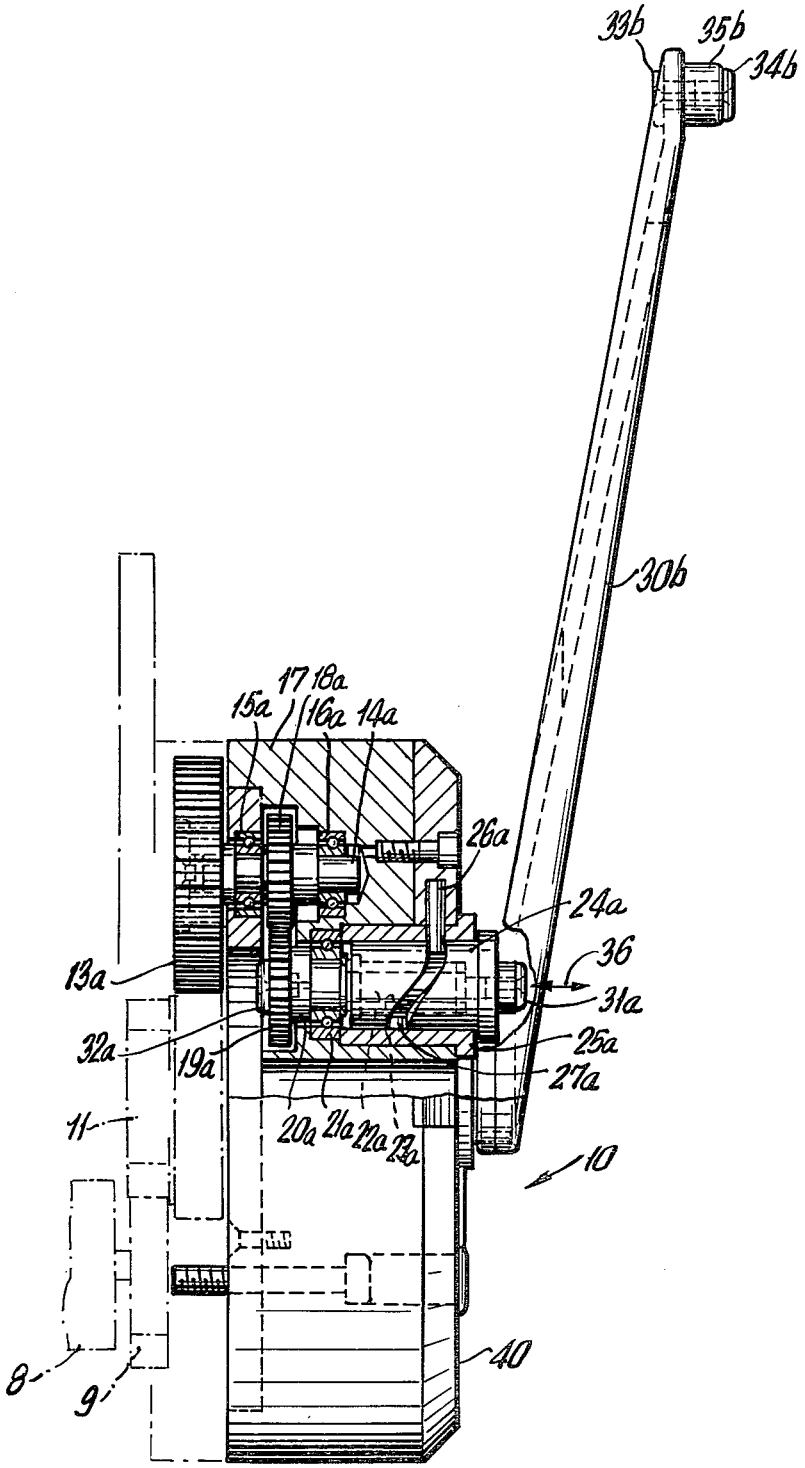
FIG. 2 is a cross-sectional view of the winding head of FIG. 1 partly broken away to show the bushing.

As shown in FIGS. 1 and 2, the coil winding head 10 includes a gear 11 which is directly driven by the gear 9 driven by the motor means 8. For example, the gear 11 may be directly driven by a gear 9 on the output shaft of the a.c. motor 8. The gear 11 is fixed to the driver gear 12; for example, the gears 11 and 12 may both be fixed to the same shaft or alternatively they may be a unitary member having two gear portions. The driver gear 12 is in mesh and drives the first driven gear 13*a* which is fixed to the supporting shaft 14*a*. The supporting shaft 14*a* is rotatably mounted by bearings 15*a*, 16*a* in the housing 17 of the coil winding head 10.

The second driven gear 18*a* is fixed to the supporting shaft 14*a*. The inner races of bearings 15*a*, 16*a* are fixed to supporting shaft 14*a* and their outer races are secured in the housing 17. The second driven gear 18*a* is in mesh with the third driven gear 19*a* which is fixed to the shaft 20*a*. The shaft 20*a* is rotatably secured in housing 17 by the bearing 21*a*.

The shaft 20*a*, at its outer end 22*a*, is square in cross-section and slidingly fits within the bore 23*a* of the bushing 24*a*. The internal bore 23*a* of the bushing 24*a* is square in cross-section and slightly larger in cross-section than the square cross-sectional outer end 22*a* of shaft 20*a*, so that the shaft 20*a* turns the bushing and yet the bushing may be reciprocated slidingly back and forth on the outer end 22*a*. The bushing 24*a* is rotatably mounted in the sleeve 25*a* and the sleeve 25*a* is fixed to the housing 17. A hardened steel pin 26*a* is secured within the forward end of the housing 17 and protrudes within a slot (groove) 27*a* of the bushing 24*a*. The slot 27*a* is at an angle to the axis of bushing 24*a* and is a continuous channel.

The fixed pin 26*a* and the angled slot 27*a* of the bushing 24*a* serve to cam the bushing in a reciprocating motion in the direction inwardly and outwardly, as shown by arrow 36, simultaneous with the rotation of the bushing 24*a*. The rotation of the shaft 20*a* causes both the rotation of the bushing 24*a* and its reciprocal motion in the direction back and forth along its axis. The flyer arm 30*a*, because it is fixed to the bushing 24*a*, will rotate and reciprocate at the same speed, direction and distance as the bushing 24*a*. The flyer arm 30*a* preferably is in a ratio of rotation of 1:1 with the driver gear 12, i.e., it rotates at the same speed as driver gear 12.

The flyer arm 30*a* (crank arm) is fixed to the bushing 24*a* at its outer end. The flyer arm, at its inner end, carries a ceramic ring-like eyelet 31*a* which is the entry to the bore of the shaft 20*a*. A similar ring-like ceramic eyelet 32*a* is fixed at the rear end of the hollow shaft 20*a*. The eyelets 31*a*,32*a* rotate with the rotation of the shaft 20*a*. The eyelets 32*a* and 31*a* serve to guide the wire, i.e., the drawn wire laid down on the mandrel, through the head without twisting the wire. The wire is lead on the exterior of the flyer arm 30*a*, then through an inner ring-like ceramic eyelet 33*a*, and then through an outer ring-like ceramic eyelet 34*a*, the eyelets 33*a* and 34*a* being mounted on a tube member 35*a*.

The number of flyer arms, two, three, four or more, depends upon the number of wires to be simultaneously laid on the mandrel by the winding head. If a user will only wind coils having two wires he may utilize the two-flyer-arm embodiment of FIGS. 1 and 2. But if he will use three or four wires, then he will utilize the respective three-flyer-arm and four-flyer-arm embodiments of the respective FIGS. 3 and 4.

Figure 4:
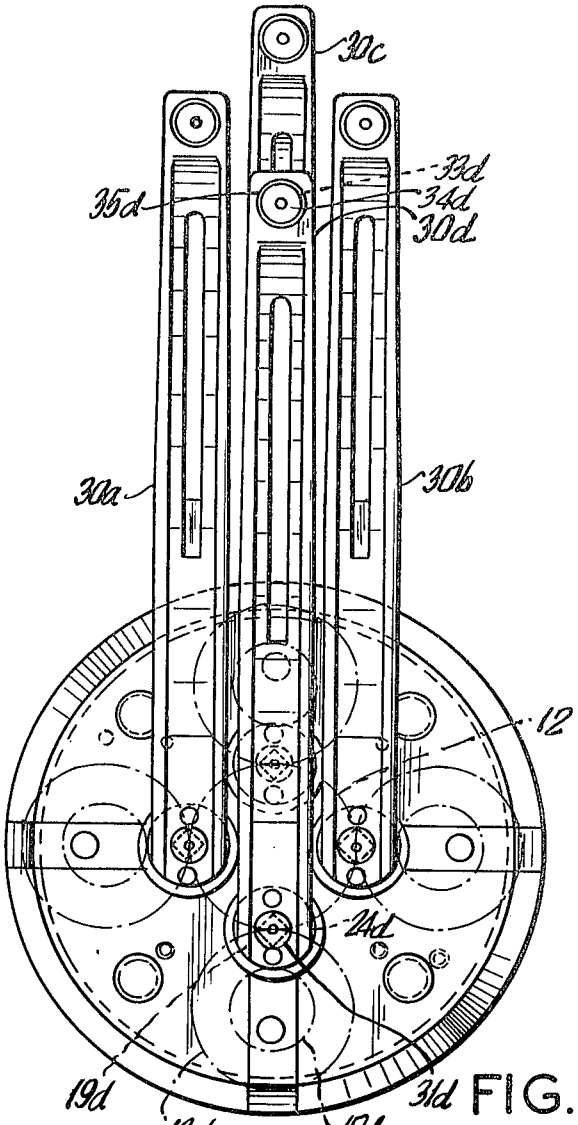
FIG. 4 is a front plan view of the quadfilar winding head of the present invention.

The user may have a coil winding head of the embodiment shown in FIG. 4 having four flyer arms and desire, in one series of coils, to use only two wires. Preferably he would exchange heads, as explained below. Alternatively, he may remove all four of the flyer arms and their bushings and put back only two of the flyer arms with different bushings in the flyer arm starting positions shown in FIG. 1.

The slots in the bushings determine the timing of the lateral reciprocating action, i.e., along the axis of the bushing. That lateral reciprocating timing is different in the case of the two, three and four flyer arm embodiments. In each case the lateral timing is such that the arms cross each other while the arms are in different planes, i.e, at different distances from the face 40 of the casing 17.

Figure 3:
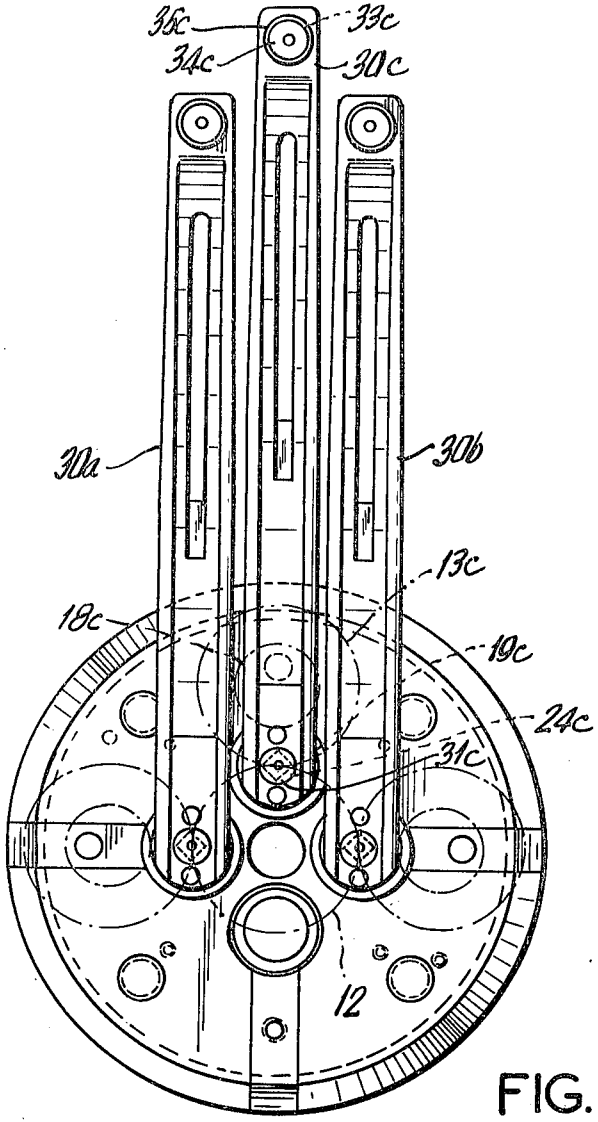
FIG. 3 is a front plan view of the trifilar winding head of the present invention.

In the following charts the lateral timing, in angles, refers to the starting positions of the flyer arms as zero degrees, as shown in FIGS. 1, 3 and 4. Each flyer arm rotates clockwise from 0° to 360° in a smooth, continuous motion. However, for purpose of illustration the lateral positions of each flyer arm are given at their four angular positions, namely, 0°, 90°, 180° and 270°. The relative lateral movement is illustrated in the charts by the letters A, B and C, in which A is the plane closest to the face 40 of the winding head 10, B is the intermediate plane and C is the plane farthest away from the face 40 of the head 10.

In the case of two flyer arms, shown in FIGS. 1 and 2, the lateral timing chart is as follows:

| | arms | |
|---|---|---|
| degrees | 30a | 30b |
| 0° to 90° | B | A |
| 90° to 180° | A | A |
| 180° to 270° | A | B |
| 270° to 360° | A | A |

In the case of three flyer arms, shown in FIG. 3, the lateral timing chart is as follows:

| | arms | | |
|---|---|---|---|
| degrees | 30a | 30b | 30c |
| 0° to 90° | B | A | A |
| 90° to 180° | A | A | B |
| 180° to 270° | A | C | B |
| 270° to 360° | A | A | A |

In the case of four flyer arms, shown in FIG. 4, the lateral timing chart is as follows:

| | arms | | | |
|---|---|---|---|---|
| degrees | 30a | 30b | 30c | 30d |
| 0° to 90° | C | A | A | B |
| 90° to 180° | A | A | B | A |
| 180° to 270° | A | C | B | A |
| 270° to 360° | A | A | A | B |

The drive train of gears to drive the flyer arm 30*a* consists of, in order and in mesh with each other, driver gear 12, first driven gear 13*a*, second driven gear 18*a* and third driven gear 19*a*. A similar drive train of gears is used to rotate and reciprocate the second flyer arm 30*b*. The corresponding parts are labeled with the same number 30*b* (shown in FIGS. 1 and 2); but with the suffix "b" referring to the drive mechanism for the second flyer arm; and with the suffix "c" referring to the drive mechanism for the third flyer arm 30*c* (shown in FIGS. 3 and 4); and the suffix "d" referring to the drive mechanism for the fourth flyer arm 30*d* (shown in FIG. 4). Consequently, the drive train of gears to drive the second flyer arm 30*b* consists of, in order and in mesh, driver gear 12 and, not shown in the figures, a first driven gear 13*b*, a second driven gear 18*b* and a third driven gear 19*b*.

The second flyer arm 30*b* is fixed to the bushing 24*b*; the bushing 24*b* carries eyelet 31*b* and the flyer arm 30*b* carries eyelets 33*b*, 34*b* on tube members 35*b* to guide the second wire.

The drive train of gears to drive the third flyer arm 30*c* (shown in FIGS. 3 and 4) consists of, in order and in mesh, driver gear 12 (the same drive gear as drives driven gear 13*a*, 13*b*) and (not shown in the figures), a first driven gear 13*c*, a second driven gear 18*c* and a third driven gear 19*c*. The third flyer arm 30*c* is fixed to the bushing 24*c*, and the bushing 24*c* carries eyelet 31*c* and the flyer arm 30*c* carries eyelets 33*c*, 34*c* on tube member 35*c* to guide the third wire.

Further, the drive train of gears to drive the fourth flyer arm 30*d* consists of, in order and in mesh, driver gear 12 and (not shown in the figures), a first driven gear 13*d*, a second driven gear 18*d*, and a third driven gear 19*d*. The fourth flyer arm 30*d* is fixed to the bushing 24*d* and the bushing 24*d* carries eyelet 31*d* and the flyer arm 30*d* carries eyelets 33*d*, 34*d* on tube member 35*d* to guide the fourth wire.

The winding head may be readily replaced by unscrewing the bolts from a flange of the coil winding machine base. For example, the head winding two wires (the head of FIGS. 1 and 2) may be replaced by a head winding three wires (the head of FIG. 3). The gear 13*a* of the first head (FIGS. 1 and 2) will be taken out of mesh with the gear 12 and replaced by the corresponding gear of the other head.

It will be understood that the winding head of the present invention may have 1, 2, 3, 4 or more flyer arms each with its own gear drive train and bushing. For example, the winding head of FIGS. 1 and 2 has two flyer arms 30*a*, 30*b* and the winding head of FIG. 4 has four flyer arms 30*a*, 30*b*, 30*c* and 30*d*.

What is claimed is:

1. A machine for winding a coil onto a mandrel with at least two wires, said machine including a base, motor means mounted on said base, means to hold a single mandrel which is wound with the said two wires, and a winding head mounted on said base and driven by said motor means, said winding head including:

a housing attached to said base;

a first and a second wire feed means each rotatively mounted in said housing and each adapted to feed one of said wires therethrough;

a first and a second flyer arm connected respectively to said first and second wire feed means, said flyer arms having portions thereof of sufficient lengths so that their circles of rotation intersect;

means for mounting each of said flyer arms on said housing, said mounting means mounting said flyer arms for rotation with the circle of rotation of one flyer arm intersecting the circle of rotation of the other flyer arm if rotation occurred in the same plane;

a first and a second flyer wire guide means respectively carried by said first and second flyer arms to guide their respective wires onto said mandrel;

flyer arm rotation means driven by said motor means to rotate each of said flyer arms; and flyer arm reciprocating means to axially reciprocate each of said flyer arms at times simultaneously with their rotation and along their axis of rotation, said reciprocation of said flyer arms being simultaneously at times in opposite axial directions and never simultaneously in the same direction, so that the flyer arms do not collide in their rotation although they would collide if they were in the same plane.

2. A machine for winding coils as in claim 1 wherein each of said wire feed means is a hollow bushing, said wire feeds through the bore of said bushing, and said bushing is fixed to said flyer arm.

3. A machine for winding coils as in claim 2 wherein each of said bushings carries a ring-like eyelet to guide said wire.

4. A machine for winding coils as in claim 1 wherein said reciprocating means is a fixed cam member fixed to said housing which acts upon a rotating member.

5. A machine for winding coils as in claim 2 wherein said reciprocating means comprises a cam pin fixed to said housing and a cam slot in said bushing, said slot being angled to the axis of said bushing.

6. A machine for winding coils as in claim 2 wherein said flyer arm rotation means includes a series of gears comprising a gear train with said gears rotatively mounted on said housing and connected between said motor means and said bushings to rotate said bushings.

7. A machine for winding coils as in claim 6 wherein said gear train includes a driver gear driven by said motor means and two sets of driven gears to each respectively drive one of said bushings, each set of driven gears comprising a first driven gear in mesh with said driver gear and fixed to a supporting shaft, a second driven gear fixed to said supporting shaft, and a third driven gear in mesh with said second driven gear and in driving connection with said bushing.

8. A machine for winding coils as in claim 7 wherein each of said third driven gears is fixed to a respective bushing drive shaft and each bushing drive shaft is in sliding axial connection with its respective bushing so that the bushing may slide axially on the bushing shaft simultaneously with said bushing being rotated by said bushing shaft.

9. A machine for winding a saddle-shaped coil onto a mandrel with at least two wires, said machine including a base, motor means mounted on said base, means to hold a single mandrel which is wound with the said two wires, and a winding head mounted on said base and driven by said motor means, said winding head including:

a housing attached to said base;

a first and a second hollow bushing, each bushing being rotatively mounted in said housing and each bushing being adapted to feed one of said wires therethrough;

a first and a second flyer arm connected respectively to said first and second bushings, said flyer arms having portions thereof of sufficient lengths so that their circles of rotation intersect;

said bushings mounting said flyer arms for rotation with the circle of rotation of one flyer arm intersecting the circle of rotation of the other flyer arm if rotation occurred in the same plane;

a first and a second flyer ring-like eyelet wire guide means respectively carried at its free ends by said first and second flyer arms to guide their respective wires onto said mandrel;

rotation means driven by said motor means and including a gear train rotatively mounted in said housing to rotate each of said bushings; and axial reciprocating means to reciprocate each of said bushings at times simultaneously with their rotation and along their axis of rotation, said reciprocation being simultaneously at times in opposite axial directions and never simultaneously in the same axial direction, so that the flyer arms do not collide in their rotation although they would collide if they were in the same plane.

10. A machine for winding a coil onto a mandrel with three wires, said machine including a base, motor means mounted on said base, and a winding head mounted on said base and driven by said motor means, said winding head including:

a housing mounted on said base;

a first and a second and a third hollow bushing, each bushing being rotatively mounted in said housing and each bushing being adapted to feed one of said wires therethrough;

a first, second and third flyer arm connected respectively to said first, second and third bushing, each flyer arm having a circle of rotation which overlaps the circle of rotation of the other flyer arms;

a first, second and third flyer wire guide means respectively carried by said first, second and third flyer arms to guide their respective wires onto said mandrel;

flyer arm rotation means to rotate each of said bushings and driven by said motor means;

axial reciprocating means to reciprocate each of said bushings at times simultaneously with their rotation and along their axis of rotation, said reciprocation being in a preselected sequence and in opposite axial directions, and at most two of said bushings moving simultaneously in the same axial direction, so that the flyer arms cross each other in different planes.

11. A machine for winding a coil onto a mandrel with four wires, said machine including a base, motor means mounted on said base, and a winding head mounted on said base and driven by said motor means, said winding head including:

a housing mounted on said base;

a first, second, third and fourth hollow bushing, each bushing being rotatively mounted in said housing and each bushing being adapted to feed one of said wires therethrough;

a first, second, third and fourth flyer arm connected respectively to said first, second, third and fourth wire feed means, each flyer arm having a circle of rotation which overlaps the circle of rotation of the other flyer arms; and a first, second, third and fourth flyer wire guide means respectively carried by said first, second, third and fourth flyer arms to guide their respective wires onto said mandrel;

flyer arm rotation means to rotate each of said bushings and driven by said motor means; and axial reciprocating means to reciprocate each of said bushings at times simultaneously with their rotation and along their axis of rotation, said reciprocation being in a preselected sequence, in opposite axial directions, and at most two of said bushings moving simultaneously in the same axial direction, so that the flyer arms cross each other in different planes.

* * * * *